United States Patent [19]

Mack et al.

[11] Patent Number: 4,753,065

[45] Date of Patent: Jun. 28, 1988

[54] METHOD OF AND APPARATUS FOR AUTOMATICALLY REPLACING ROVING BOBBINS OF A SPINNING MACHINE

[75] Inventors: Karl-Heinz Mack, Weilheim; Wolfgang Igel, Ebersbach, both of Fed. Rep. of Germany

[73] Assignee: Zinser Textilmaschinen GmbH, Ebersbach/Fils, Fed. Rep. of Germany

[21] Appl. No.: 17,892

[22] Filed: Feb. 24, 1987

[30] Foreign Application Priority Data

Feb. 28, 1986 [DE] Fed. Rep. of Germany ..... 3606612

[51] Int. Cl.[4] ..... D01H 9/08

[52] U.S. Cl. ..... 57/266; 57/281

[58] Field of Search ..... 57/266, 267, 268, 274, 57/275–278, 281, 270, 271

[56] References Cited

U.S. PATENT DOCUMENTS 3,773,191 11/1973 Ishida ..... 57/281 X
3,854,275 12/1974 Bethea et al. ..... 57/281
3,905,184 9/1975 Takai et al. ..... 57/274
3,935,699 2/1976 Iida et al. ..... 57/267
4,023,339 5/1977 Laderbach et al. ..... 57/281 X
4,473,997 10/1984 Kawasaki et al. ..... 57/281 X

FOREIGN PATENT DOCUMENTS 0050271 4/1982 European Pat. Off. .

*Primary Examiner*—Donald Watkins
*Attorney, Agent, or Firm*—Karl F. Ross; Herbert Dubno

[57] ABSTRACT

Apparatus and methods for automatically replacing emptying yarn spools at a spinning machine, especially ring spinning machines, which machines include a spool frame and a plurality of spinning stations, wherein full spools are brought to and empty spools are moved away from the spinning stations. Full spools are arranged along the spool frame of the spinning machine in at least one magazine row, either individually, or a plurality thereof in sections, and the magazine row in the region of the first emptying spool, or section of spools, includes an empty location. This empty or bypass location is intermittently along the magazine row.

19 Claims, 4 Drawing Sheets

METHOD OF AND APPARATUS FOR AUTOMATICALLY REPLACING ROVING BOBBINS OF A SPINNING MACHINE

FIELD OF THE INVENTION

Our present invention relates to a method of and to an apparatus for automatically replacing the roving bobbins of a spinning machine, especially a ring spinning machine, as such bobbins or spools are depleted.

More particularly, the invention relates to a method and an apparatus for automatically replacing empty spools or spools substantially depleted of the roving supply of a spinning machine having a spool rack or frame and a plurality of spinning stations.

BACKGROUND OF THE INVENTION

European patent application Nos. 0 062 063 and 0 050 271 describe an automatic exchange of yarn spools in spinning machines, by replacing sections of spools in a ring spinning machine. A number of spool carriers for neighboring spinning stations on each side of the machine comprise a group and are arranged at a mobile magazine. The magazine or pairs of them can be moved in the longitudinal direction of the spinning machine by means of a transport device, and a lifting device serves to deposit respective magazines either alone or in pairs at a predetermined location, and they can be picked up again by the lifting device.

A drawback of such apparatus is that the conveying means of the apparatus brings the sections with the full spools from a magazine at one end of the spinning machine, and it delivers the sections with the empty spools into a magazine at the other end of the machine. Thus, there is a substantial loss of time for transport of the full and empty spools. Consequently, a greater number of the handling devices is required or the operation of the various handling devices needs to be very precisely coordinated or programmed for the operation of the associated ring spinning machine.

OBJECTS OF THE INVENTION

It is therefore the principal object of the present invention to provide an improved method of and apparatus for roving bobbin replacement which preclude the disadvantages and problems of the prior art.

It is also an object to provide an improved method of and apparatus for the purpose described which allow a more efficient operation.

It is further an object of the invention to provide a method of and an apparatus for roving bobbin replacement in a ring spinning machine with which a more economical structural arrangement is achieved.

It is yet another object of the invention to provide an improved automatic bobbin replacement apparatus which is compact and in which the operational distances are reduced to afford a more rapid operation.

SUMMARY OF THE INVENTION

The foregoing and other objects and advantages of the invention are obtained in accordance with one method aspect in which the full spools are arranged along the spool frame of the spinning machine in at least one magazine row either individually or in sections. The magazine row in the region of the first emptying spool, or section, includes an empty location. The exchange of the empty spool by a full spool is done successively at neighboring individual spinning stations, or sections of spinning stations, whereby the empty location moves as it were, intermittently and incrementally along the magazine row.

This method provides the substantial advantage of improved efficiency, because the full spools, or groups or sections of them, need no longer be brought from one end of the machine or delivered to an end of the machine when empty. Instead, the method allows quick, on the spot, replacement of the spools to replenish the roving supply. Furthermore, the spools can be delivered and removed very closely to and from the spinning stations where they are required, and lengthy travel distances and, consequently, lengthy replacement times are avoided.

In another aspect of the method full spools are arranged along the spool frame of the spinning machine in at least one magazine row, either individually or in sections, the magazine row includes at least one empty location, and the respective position of the empty location and the position of empty spools, or of sections with empty spools, is correspondingly stroed, and the replacement steps are automatically controlled in conformity with the stored positions.

This method is particularly applicable for stations requiring an ad hoc or occasional replacement, i.e. for so-called wild card situations, and it may be preferred over a regular exchange of spools to replenish roving.

The apparatus according to the invention is primarily characterized by an exchange device which is adapted to be selectively moved in three mutually perpendicular directions, and by means of the device individual or sections of spools can be moved along the spool frame and between the spool frame and the magazine.

According to one aspect of our invention, therefore, a method for automatically replacing roving bobbins in a spinning machine, especially a ring spinning machine, of the type in which bobbins are positioned at a bobbin frame to supply roving to respective spinning stations, comprises transporting full bobbins to and empty bobbins away from the spinning stations, and arranging the bobbins in a pattern comprising sites which are occupied by bobbins and sites which are capable of being occupied by bobbins, but which are temporarily unoccupied. Respective full bobbins are arranged along the bobbin frame of the spinning machine to provide at least one magazine row, and the magazine row at that location where a first emptying bobbin is nearing depletion includes a site capable of being occupied. We selectively replace empty bobbins by full bobbins at respective neighboring spinning stations, with the site capable of being occupied moving correspondingly along with reference to the magazine row.

For carrying out the transporting step, we position the bobbins on bobbin carriers for transporting full bobbins to and empty bobbins away from the respective spinning stations.

Advantageously a plurality of bobbins is handled in bobbin sections at respective sites of the magazine row and the respective site capable of being occupied is of equivalent a real extent.

Preferably at least two magazine rows are arranged along the bobbin frame of the spinning machine and both of the magazine rows can be filled with full bobbins except for one empty location adapted to receive a full bobbin section in each row.

An apparatus for carrying out the method advantageously includes means for replacing bobbins individually and in sections, the means being adapted to be moved in three mutually perpendicularly arranged directions, with reference to and along the bobbin frame, and between the bobbin frame and the at least one magazine row.

Preferably the replacing means includes a lifting device for vertically moving respective bobbins, a transport unit for horizontally moving the lifting device, but transversely with reference to the bobbin frame, and a drive unit for moving the replacing means parallel with respect to the bobbin frame.

The lifting device can include a piston and cylinder unit and/or a vertically moveable scissors system.

The transport unit can also include a screw spindle which extends transversely with respect to the bobbin frame or a pulling or traction member which extends transversely with respect to the bobbin frame.

The lifting device can have a coupling device to which can be releasably secured individual full bobbins but also empty bobbins, and respective carriers thereof.

A drive unit can be provided which has rollers which extend at a predetermined angle with respect to one another, and a rail for supporting the rollers, at least one roller being connected to a respective drive.

BRIEF DESCRIPTION OF THE DRAWING

The above and other objects, features and advantages of the invention will become more readily apparent from the following description, reference being made to the accompanying highly diagrammatic drawing in which.

SPECIFIC DESCRIPTION

Figure 1:
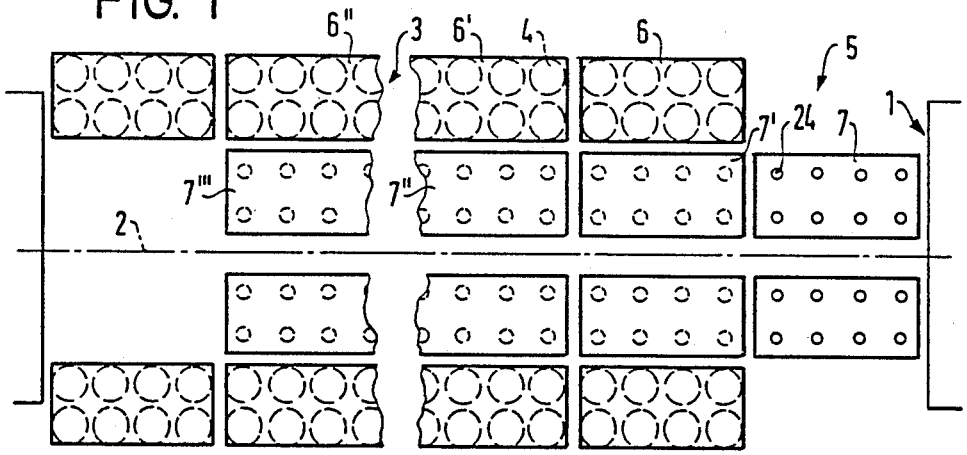
FIG. 1 is a schematic top plan view of a spinning machine frame with two magazine rows and with sectionally arranged full spools.

The invention is applicable to a spinning machine, especially a ring spinning machine, which is generally identified by reference numeral 1 and has a median plane 2 in FIG. 1. The machine includes a spool frame or rack (not shown in detail) and a plurality of spinning stations as is all known in the art.

The full spools 4 are arranged along the spool frame of the spining machine 1 in a magazine row 3. Each magazine row 3, in turn, is comprised of sections 6, 6', 6''.

Across from and alongside the sections of row 3 are sections 7, 7', 7'', 7''' of emptying or nearly empty spools 24 which supply the roving to the spinning stations. Section 7 is to run out of material first, and it is situated adjacent an empty or unoccupied location 5.

Figure 2:
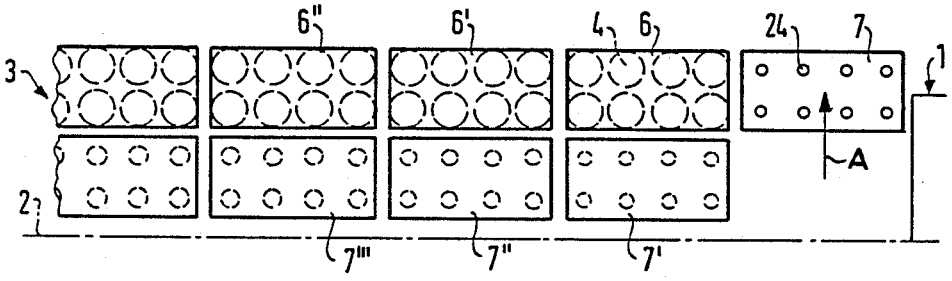
FIGS. 2 to 4 also show schematic top plan views of the exchange operation at a part of the machine.
Figure 3:
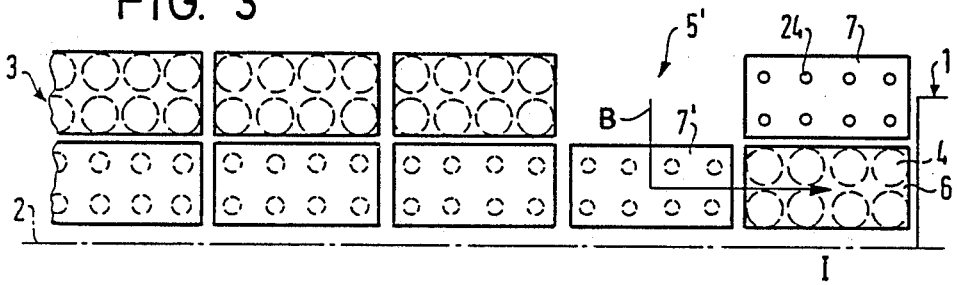

With reference to FIG. 2, section 7 is the first to run out of roving and; when this occurs, it is transported into the empty location 5 in the direction of arrow A. Next, section 6 with the full spools 4 is moved into the position I, previously occupied by section 7, following the path indicated by the arrow B in FIG. 3. This will create an empty location 5' which can be occupied, when required, by section 7' with its subsequently emptying spools 24.

Figure 4:
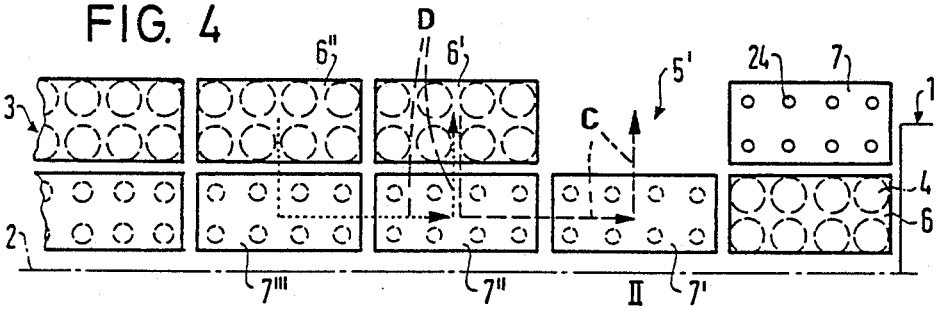

Section 6' can then correspondingly be transported in the direction of the dash-line arrow C into position II. The subsequent replacement is carried out analogously as indicated by the dot-line arrow D, see FIG. 4.

Accordingly, with successive replacements being effected, the empty location or sites (5) are progressively positioned, or moved as it were, along the row 3. Due to this technique, very short travel distances are achieved for the replacement operations.

The magazine row 3 of FIG. 2 with the sections 6, 6', 6'' etc. for the full spools 4 corresponds to the magazine or storage position, i.e. the back-up supply or position of the system. The sections 7, 7', 7'', 7''' etc. containing the emptying or empty spools represent the use or demand supply or position of the system.

In general terms, the sections 6 and 7 can accommodate two to eight spools.

FIGS. 5 to 8 and 9 to 12 show two different embodiments of apparatus for replacing spools in accordance with the methods of the invention.

Each apparatus includes a lifting device 9, a transport unit 16, and a drive unit 35 for moving full spools 4 and empty spools 24, or the spool carriers 10 for such spools (particulary, spool carrier 10 with the emptying spools 4, and spool carrier 10' with full spools 24). The spools are moved vertically, as well as transversely to and along the spool frame.

The embodiment of FIGS. 5 to 8 indicates that the lifting device 9 includes a vertically disposed piston and cylinder unit 11. A coupling device 33 is secured at the forward end of the piston rod 15 of the unit 11 for attachment of the spool carriers 10, via the connecting pieces 34, to the lifting device 9.

Figure 14:
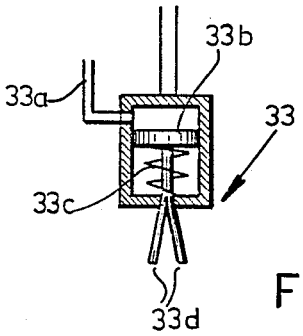
FIG. 14 is a section of the catch.

Operation of the coupling device 33 can be done by a respective control system, or by means such as are used in known so-called pending spool holders, whereby by pressure contact on the connecting piece 34 of a supported spool carrier 10, the desired connection is achieved between the spool carrier 10 and the lifting device 9. As shown in FIG. 14, for example, when pneumatic pressure is applied via line **33*a* to the piston 33*b*, the spring 33*c* is compressed and the fingers 33*d* emerge from the housing to spread and grip the bobbins or the carrier when the pressure is released the spring pulls the fingers up and inwardly to release the coupling device or catch 33**.

The cylinder **11*a* of the piston and cylinder unit 11 is secured to a nut 13 which reciprocatingly rides on the screw spindle 12. The screw spindle 12, the nut 13, and a guide rail (not shown) for the nut 13 comprise the transport unit 16 for moving the spool carriers 10 transversely with respect to the spool frame (also not shown in detail). The screw spindle 12 can be rotated to reciprocatingly move the nut 13 on it by way of an electric motor 14. The piston and cylinder unit 11, in turn, can be moved, together with the connected spool carrier 10**, transversely with respect to the spool frame.

The lifting device 9 and the transport unit 16 are movably mounted at a rail 20 by means of the drive unit 35 which includes the rollers 17 and 18. The rail 20 extend along the spool frame of the spinning machine 1. The roller 17 is driven by the electric motor 19.

Figure 5:
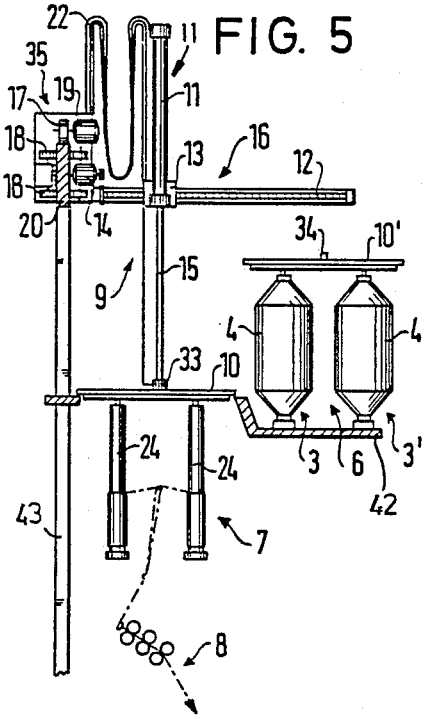
FIGS. 5 to 8 show one embodiment of the invention in side elevation and, in part, in cross section, during replacement of two magazine rows of full spools in the successive replacement phases.

In the position shown in FIG. 5, the piston rod 15 of the lifting device 9 is fully advanced, and the coupling device 33 has engaged the spool carrier 10 for empty spools 24.

Figure 6:
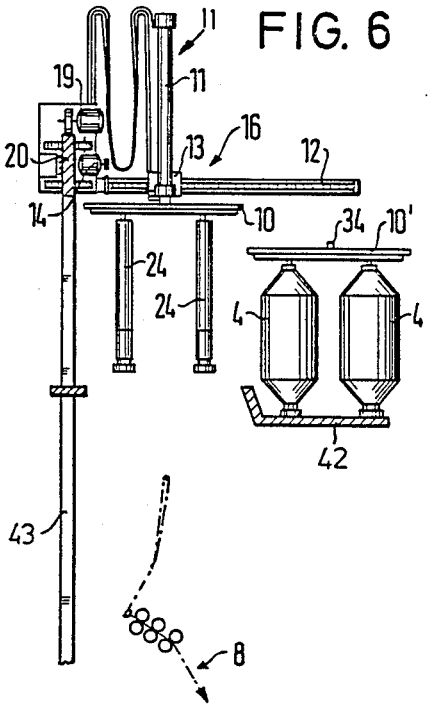

According to the position shown in FIG. 6, the spool carrier 10 has been elevated to such a level where it can be transported transversely with respect to the spool frame into the magazine.

Figure 7:
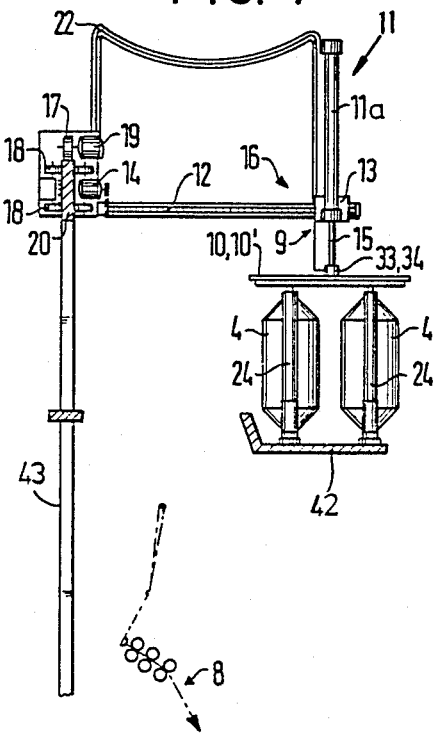

With reference to FIG. 7, the lifting device 9 and the spool carrier 10 with the empty spools 24 have been brought to the magazine or storage location by way of the transport unit 16. This is achieved by the electric motor 14 rotating the screw spindle 12 to advance the nut 13 and the piston and cylinder unit 11 transversely with respect to the spool frame, i.e. to the right. As well, the piston and cylinder unit 11 is pressurized to such an extent that the piston rod 15 lowers the spool carrier 10 for placing the empty spools 24 on respective positioning posts 41 of the magazine carrier 42. The carrier 42 is supported at the supporting frame generally identified by reference numeral 43.

Next, the coupling device 33 at the piston rod 15 is disengaged from the connecting piece 34 to release the respective spool carrier 10. The lifting device 9 and the transport unit 16 are then moved by means of the drive unit 35 along the spool frame through such a distance until the coupling device 33 at the piston rod 15 enters the reach of the spool carrier 10' for full spools 4 and the respective connecting piece 34 is positively engaged. The transport unit 16, i.e. the screw spindle 12 and the nut 13, then brings the spool carrier 10' with the full spools 4 to the spinning locations. At the respective locations the piston and cylinder unit 11 lowers the spool carrier 10' with the full spools 4. The operation of the spinning machine 1 can now continue with the full spools 4 at the spinning stations 8 as represented by the schematically shown drafting unit or mechanism.

Figure 13:
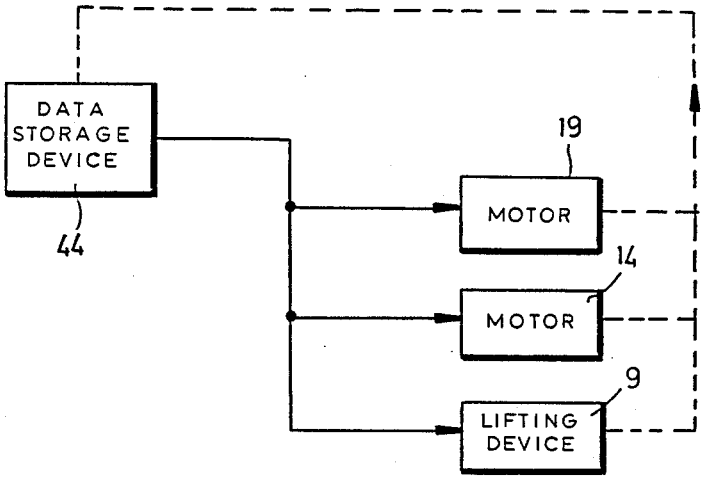
FIG. 13 is a diagram indicating the actuation of the various drives by the storage device.

From the different phases shown in FIGS. 5 to 8 it is clear that full sections 6 replace the empty sections 7 at the spinning stations 8. The respective up and down motions are achieved by a lifting device 9 including the piston and cylinder unit 11. The respective movements to and fro transversely with respect to the spool frame are done by a transport unit 16 including the screw spindle 12 and nut 13 with the latter being secured to the unit 11, and the screw spindle being rotated by the electric motor 14. The respective displacement in the longitudinal direction of the spool frame is done by the drive unit 35. The position of the empty location or site 5 can be stored in a storage device generally identified by reference numeral 44 which centrally controls the actuation of the drives, i.e. motor 14 and 19, and the lifting device 9 in conformity with the stored data. This is diagrammatically indicated in FIG. 13.

Figure 8:
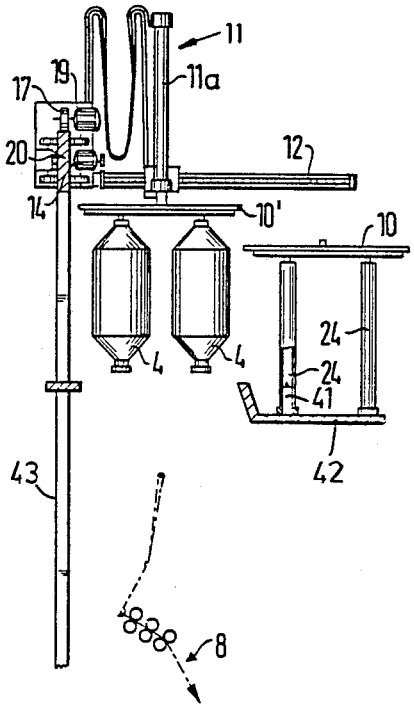

Pressure transmission for the piston and cylinder unit 11 and engagement of the coupling device 33 is by way of the hoses 22 which have a length sufficient to allow the vertical movement indicated in FIG. 5 and the horizontal motion indicated in FIG. 8. FIG. 5 also confirms that the sections 6 of full spools 4 are comprised of the two rows 3 and 3'.

In the embodiment shown in FIGS. 9 to 12 the lifting device 9 has a scissors element 30, and the transport unit 16 includes a pulling member 31. A holding part 32 is secured at the pulling member 31, and the scissors element 30 is secured at the holding part 32. The holding part 32 includes an actuator (not shown) for operating the scissors element 30. The coupling device 33 is secured at the forward or free end of the scissors element 30 for engagement and disengagement with a respective spool.

The embodiment of the apparatus shown in FIGS. 9 to 12 has a single magazine row 3 and a conveyor 40 operating along this magazine row 3 and parallel with respect to the spool frame. The magazine row 3 is supported on a carrier 42*a* which, in turn, is arranged at the frame 43. The conveyor 40 receives and transports empty spools 24'.

The transport unit 16, i.e. the pulling member 31 with the holding part 32, and the lifting device 9 are driven, in a manner analogous to that of the embodiment described with reference to FIGS. 5 to 8, in the longitudinal direction of the spool frame by the drive unit 35. This drive unit 35 comprises pairs of guiding rollers 18, and a drive roller 17 which is powered to move on the rail 20 by the electric motor 19. The electric motor 14, in turn, drives the pulling member 31. Again, the position of the empty location or site (5) can be stored in the storage device generally identified by reference numeral 44 which centrally controls the actuation of the drives, i.e. motor 14 and 19, and the lifting device 9 in conformity with the stored data, compare FIG. 13.

Figure 9:
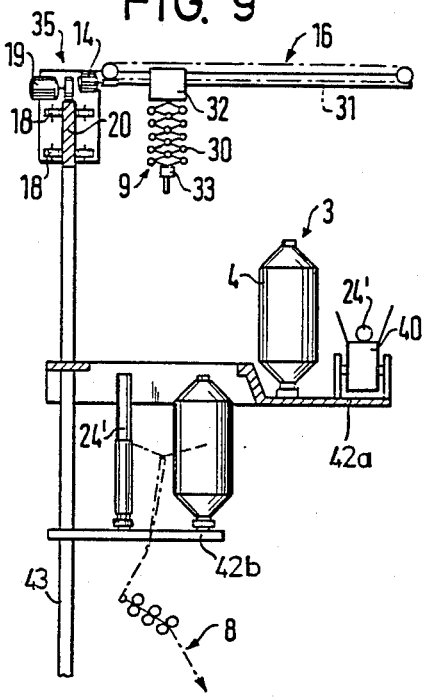
FIGS. 9 to 12 show another embodiment of the invention in side elevation, and in part in cross section, during replacement of an empty by a full spool in the successive operational phases.

In the position shown in FIG. 9, the scissors element 30 is retracted and an emptying spool 24' is in place at the spinning station 8, for example standing on the carrier 42*b* which is supported by the frame 43.

Figure 10:
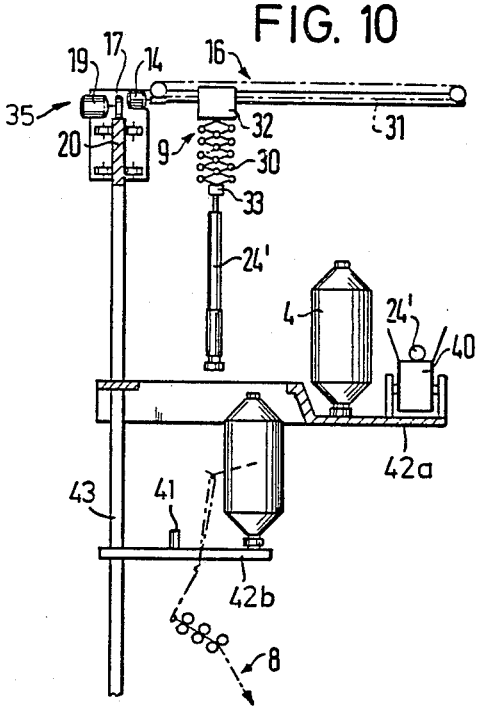
Figure 11:
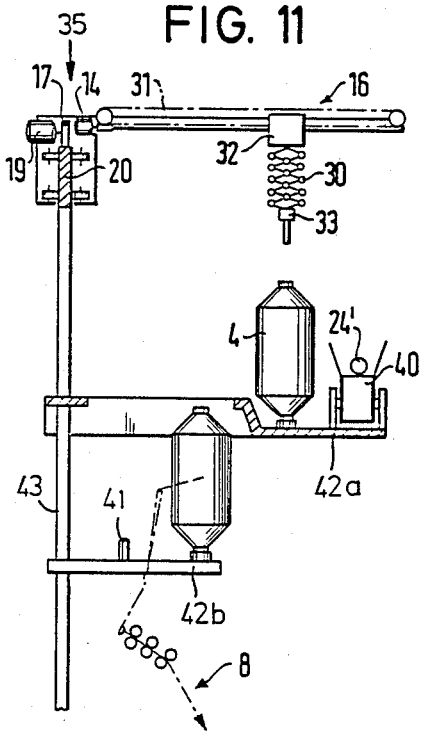
Figure 12:
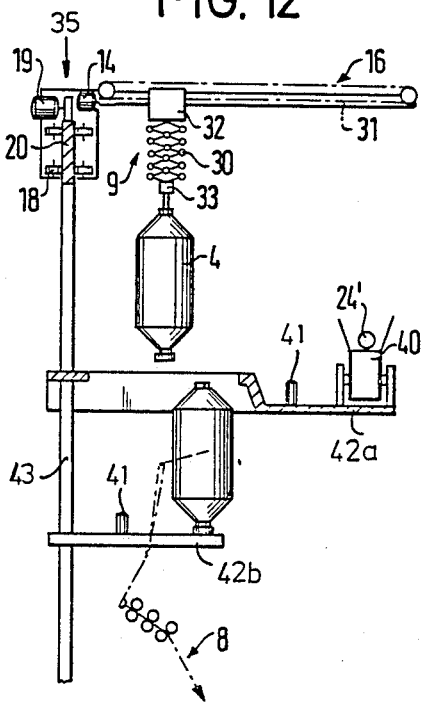

FIG. 10 shows the position after the scissors element 30 has been extended and the coupling device 33 has been engaged at the empty spool 24', whereupon the spool 24' was raised by contraction of the scissors element 30. Next, by way of the pulling member 31, i.e. the transport unit 16, the lifting device 9 is moved transversely with respect to the spool frame until the lifting device 9 is positioned above the conveyor 40. The empty spool 24' is then deposited on the conveyer 40.

Next, the scissors element 30 is retracted to be positioned above the full spool 4, the holding part 32 is actuated to extend the scissors element 30, and the coupling device 33 engages the full spool 4. The scissors element 30 is then contracted to lift the full spool 4 from its storage position in the magazine row 3, i.e. from the respective positioning post 41. According to FIG. 12, the transport unit 16 brings the spool 4 to the left until it is above the spinning station 8. The spool 4 is then lowered by extension of the scissors element 30 and it is placed on the positioning post 41. It is then available for supplying roving at the spinning station 8.

For replacement of another spool, the apparatus is moved along the spool frame by means of the drive unit 35 until the operational plane of the transport unit 16 is aligned with the axis of the respective spool. In other words, the drive unit 16 is positioned so that the coupling device 33 can engage the respective spool.

The phases indicated in FIGS. 9 to 12 are those of the so-called wild or irregular replacement of individual or non-uniformly depleting spools in the case of single magazine rows (3) of full spools (4).

In place of a conveyor 40 one can provide, or course, a second magazine row on which the empty spools 24' are supported. Thus, whereas the conveyer 40 affords depositing and removal of the empty spools at the end of the apparatus, in the event a second magazine row is used to deposit on it the empty spools, the removal of the empty spools can be done manually or automatically in sections.

As shown in the drawings, the magazine 3 along the spool frame can comprise one or two rows. This magazine can be filled at such time when no replacement need to be carried out.

The magazine can be manually replenished, or it can be replenished by another independent device, i.e. a device which is actuated independently of the described replacement apparatus.

It will be clear from the foregoing that the apparatus includes magazine rows of full spools 4 along the spool frame and the means to replace empty spools 24, 24' by full spools 4 is done "on the spot" as it were, or with very short travel distances, near the location at which such spools are required.

As indicated in FIG. 1 there is also provided an empty location or site 5 which progressively and cyclically moves along the spool frame of the spinning machine 1.

The apparatus for the method includes a coupling device 33 which can be raised and lowered, and they can be actuated to move laterally with reference to the spool frame.

The lifting device 9 can be embodied, for example, by a piston and cylinder unit 11, or scissors elements 30, and similar contracting and expanding lever systems. The transport unit 16, in turn, can be embodied by a powered screw spindle 12 and nut 13 assembly, or a pulling member 31, for example a chain.

The lifting device 9 and the transport unit 16 are arranged at a drive unit 35 which can be moved along the spool frame of the spinning machine, i.e. along the axis 2 thereof.

We claim:

1. In a method of automatically replacing emptying roving bobbins in a spinning machine which machine includes a bobbin frame and a plurality of spinning stations whereby on bobbin carriers arranged full bobbins are brought to and empty bobbins are moved away from the spinning stations the improvement wherein:

(a) the full bobbins are arranged along the bobbin frame of the spinning machine in at least one magazine row either individually or in sections:

(b) the magazine row in the region of the first emptying bobbin or section includes an empty location; and (c) the exchange of the empty bobbin by a full bobbin is done successively at neighboring individual spinning stations or sections of spinning stations, whereby the empty location moves intermittently by and by along the magazine row.

2. In a method of automatically replacing emptying roving bobbins in a spinning machine which includes a bobbin frame and a plurality of spinning stations, whereby on bobbin carriers arranged full bobbins are brought to and empty bobbins are moved away from the spinning stations the improvement wherein:

(a) the full bobbins are arranged along the bobbin frame of the spinning machine in at least one magazine row either individually or in sections;

(b) the magazine row includes at least one empty location; and (c) the respective position of the empty location and the position of empty bobbins or sections with empty bobbins is stored, and the replacement steps are automatically controlled in conformity with these stored positions so as to shift the position of the empty location.

3. In a spinning machine having a row of spinning positions each of which can receive a roving bobbin, the improvement which comprises means for replacing bobbins individually or in sections, said means being adapted to be moved in three mutually perpendicularly arranged directions, with reference to and along the bobbin frame, and between the bobbin frame and at least one magazine row extending along said row of spinning positions and having an empty location for receiving a bobbin which is to be replaced whereby a full bobbin from another location replaces the bobbin moved to the empty location to shift the position of said empty location along said row.

4. The improvement as defined in claim 3, wherein said means includes:

a lifting device for vertically moving respective bobbins;

a transport unit for horizontally moving said lifting device, but transversely with reference to the bobbin frame; and a drive unit for moving said replacing means parallel with respect to the bobbin frame.

5. The improvement as defined in claim 4, wherein said lifting device includes a piston and cylinder unit.

6. The improvement as defined in claim 4, wherein said lifting device includes a vertically moveable scissors system.

7. The improvement as defined in claim 4, wherein said transport unit includes a screw spindle which extends transversely with respect to the bobbin frame.

8. The improvement as defined in claim 4, wherein said transport unit includes a pulling member which extends transversely with respect to the bobbin frame.

9. The improvement as defined in claim 4, wherein said lifting device has a coupling device to which can be releasably secured individual full bobbins but also empty bobbins, and respective carriers thereof.

10. The improvement as defined in claim 4, wherein said drive unit includes rollers which extend at a predetermined angle with respect to one another, and further comprising a rail for supporting said rollers, and at least one roller is connected to a respective drive.

11. The improvement as defined in claim 4, wherein at least two magazine rows are arranged along the bobbin frame of the spinning machine.

12. The improvement as defined in claim 11, wherein a respective bobbin carrier serves to support two magazine rows of full bobbins.

13. The improvement as defined in claim 4, further comprising means for supporting removed empty bobbins, said means extending parallel with respect to said at least one magazine row and said bobbin frame.

14. The improvement as defined in claim 13, wherein said supporting means includes a conveyer extending along the bobbin frame, for transporting removed empty bobbins.

15. The improvement as defined in claim 4, wherein said means includes an accumulator system for storing the relative positions of empty bobbins, carriers and sections of respective bobbins, to automatically control replacement steps in conformity with the stored positions.

16. The improvement as defined in claim 15, wherein said accumulator system includes an electronic data storage unit which is capable of actuating a respective drive.

17. The improvement as defined in claim 16, wherein said electronic data storage unit is capable of actuating said lifting device.

18. A bobbin-change method for a spinning machine, said method comprising the steps of:

(a) arraying at least along one longitudinal side of an elongated spinning machine at least one row of bobbin stations each receiving a roving bobbin supplying roving to a respective spinning location whereby said bobbins are progressively emptied, the bobbins of a given number of said stations being provided on a common carrier, whereby a plurality of said carriers are provided in succession in a first carrier row along said side of said spinning machine;

(b) disposing a second carrier row of said carriers, each carrying said number of full bobbins alongside said first carrier row and providing in said carrier row an empty location corresponding to one of said carriers;

(c) upon emptying of substantially all of the bobbins of one of the carriers of the first carrier row, transferring said one of said carriers with the empty bobbins thereon laterally of said rows into said empty location in said second carrier row;

(d) thereafter transferring a replacement carrier with full bobbins thereon from another location of said second carrier row laterally and longitudinally to said first carrier row and into the position thereof formerly occupied by said one of said carriers so that the full bobbins of the replacement carrier supply the spinning locations of the empty bobbins, thereby forming another empty location at the place vacated by said replacement carrier; and (e) repeating steps (a) through (d) in succession for each of the carriers of the first carrier row as the bobbins thereof are emptied, thereby causing the empty location to travel along said second carrier row.

19. A bobbin-change system for a spinning machine which comprises:

at least one row of bobbin stations arrayed at least along one longitudinal side of an elongated spinning machine each receiving a roving bobbin supplying roving to a respective spinning location whereby said bobbins are progressively emptied, the bobbins of a given number of said stations being provided on a common carrier, whereby a plurality of said carriers are provided in succession in a first carrier row along said side of said spinning machine;

means forming a second carrier row of said carriers, each carrying said number of full bobbins, disposed alongside said first carrier row, said second carrier row having an empty location corresponding to one of said carriers;

drive means engageable with said carriers for moving said carriers in three mutually perpendicular directions and effective upon emptying of substantially all of the bobbins of one of the carriers of the first carrier row, for transferring said one of said carriers with the empty bobbins thereon laterally of said rows into said empty location in said second carrier row, and thereafter transferring a replacement carrier with full bobbins thereon from another location of said second carrier row laterally and longitudinally to said first carrier row and into the position thereof formerly occupied by said one of said carriers so that the full bobbins of the replacement carrier supply the spinning locations of the empty bobbins, thereby forming another empty location at the place vacated by said replacement carrier; and control means for automatically operating said drive means to replace each of the carriers of the first carrier row as the bobbins thereof are emptied, thereby causing the empty location to travel along said second carrier row.

* * * * *